US008328169B2

(12) United States Patent
Kuno et al.

(10) Patent No.: US 8,328,169 B2
(45) Date of Patent: Dec. 11, 2012

(54) SPRING STEEL AND SPRING HAVING SUPERIOR CORROSION FATIGUE STRENGTH

(75) Inventors: Takanori Kuno, Nagoya (JP); Tomohiro Nakano, Nagoya (JP); Takayuki Sakakibara, Nagoya (JP); Masami Wakita, Nagoya (JP); Shingo Mimura, Nagoya (JP)

(73) Assignee: Chuo Hatsujo Kabushiki Kaisha, Nagoya-Shi (JP)

( * ) Notice: Subject to any disclaimer, the term of this patent is extended or adjusted under 35 U.S.C. 154(b) by 88 days.

(21) Appl. No.: 12/892,444

(22) Filed: Sep. 28, 2010

(65) Prior Publication Data

US 2011/0074077 A1 Mar. 31, 2011

(30) Foreign Application Priority Data

Sep. 29, 2009 (JP) ..... 2009-225422
Sep. 29, 2009 (JP) ..... 2009-225423
Sep. 29, 2009 (JP) ..... 2009-225424
Jan. 19, 2010 (JP) ..... 2010-009072

(51) Int. Cl.
*C22C 38/18* (2006.01)

(52) U.S. Cl. ..... 267/2; 267/158; 267/166; 267/182; 148/320; 148/333

(58) Field of Classification Search ..... 267/33–35, 267/155–157, 166, 286–289, 2, 182; 148/320–334, 148/580, 598
See application file for complete search history.

(56) References Cited

U.S. PATENT DOCUMENTS 4,448,617 A 5/1984 Yamamoto et al.
4,544,406 A 10/1985 Yamamoto et al.
5,009,843 A 4/1991 Sugimoto et al.
5,225,008 A 7/1993 Koyama et al.
5,258,082 A 11/1993 Koyama et al.
5,863,358 A 1/1999 Krzysztalowicz
5,897,717 A 4/1999 Hashimura et al.
6,017,641 A 1/2000 Aoki et al.
6,027,577 A 2/2000 Mikura et al.
6,193,816 B1 2/2001 Nakano et al.
6,375,174 B2 4/2002 Hasegawa et al.
6,406,565 B1 6/2002 Hashimura et al.
6,543,757 B2 4/2003 Imaizumi
6,550,301 B2 4/2003 Hasegawa
6,616,131 B2 9/2003 Imaizumi
6,648,996 B2 11/2003 Hasegawa
6,712,346 B2 3/2004 Imaizumi
6,779,564 B2 8/2004 Hasegawa et al.
6,836,964 B2 1/2005 Hasegawa et al.
7,407,555 B2 8/2008 Yoshikawa et al.
7,597,768 B2 * 10/2009 Suda et al. ..... 148/334
7,615,186 B2 * 11/2009 Suda et al. ..... 420/104
7,699,943 B2 4/2010 Nakano et al.
7,776,440 B2 8/2010 Kunita et al.
2005/0173028 A1 * 8/2005 Suda et al. ..... 148/333
2006/0169367 A1 * 8/2006 Yuse et al. ..... 148/320
2006/0196584 A1 * 9/2006 Kochi et al. ..... 148/332
2006/0201588 A1 * 9/2006 Suda et al. ..... 148/333
2007/0163680 A1 * 7/2007 Suda et al. ..... 148/333
2007/0256765 A1 * 11/2007 Kimura et al. ..... 148/580
2008/0163957 A1 7/2008 Brady et al.
2008/0271824 A1 * 11/2008 Fujino et al. ..... 148/598
2008/0308195 A1 * 12/2008 Yoshihara et al. ..... 148/547
2009/0020189 A1 * 1/2009 Yoshihara et al. ..... 148/506
2009/0020195 A1 * 1/2009 Kubota et al. ..... 148/580
2009/0079246 A1 3/2009 Okura et al.
2009/0174129 A1 * 7/2009 Izumida et al. ..... 267/167
2009/0283181 A1 * 11/2009 Suda et al. ..... 148/318
2010/0175795 A1 * 7/2010 Choi et al. ..... 148/598
2010/0224287 A1 * 9/2010 Kochi et al. ..... 148/504
2011/0074076 A1 3/2011 Kuno et al.
2011/0074078 A1 3/2011 Nakano et al.
2011/0074079 A1 3/2011 Nakano et al.
2011/0303327 A1 * 12/2011 Yoshihara et al. ..... 148/506

FOREIGN PATENT DOCUMENTS

JP 7-292435 A 11/1995

OTHER PUBLICATIONS

Excerpt from the textbook SPRING, 4th edition edited by the Japan Society of Spring Engineers 2008, p. 508.
Amendment and Response to non-final Office Action mailed Apr. 25, 2012 for U.S. Appl. No. 12/892,445.
Office Action mailed Apr. 25, 2012 for U.S. Appl. No. 12/892,445.

* cited by examiner

*Primary Examiner* — Christopher Schwartz
(74) *Attorney, Agent, or Firm* — J-Tek Law PLLC; Jeffrey D. Tekanic

(57) ABSTRACT

The present application provides a high strength spring steel and a high strength spring that have superior corrosion fatigue strength. The spring steel comprises, in terms of percent by mass, 0.35-0.55% C, 1.60-3.00% Si, 0.20-1.50% Mn, 0.10-1.50% Cr and at least one element selected from 0.40-3.00% Ni, 0.05-0.50% Mo 0.05-0.50% V, the balance being at least substantially Fe and incidental elements and impurities.

20 Claims, No Drawings

SPRING STEEL AND SPRING HAVING SUPERIOR CORROSION FATIGUE STRENGTH

CROSS-REFERENCE TO RELATED APPLICATIONS

This application claims priority to Japanese Patent Application Nos. 2009-225422, 2009-225423 and 2009-225424, all of which were filed on Sep. 29, 2009, and to Japanese Patent Application No. 2010-009072 filed on Jan. 19, 2010, the contents of all of which are hereby incorporated by reference into the present application.

TECHNICAL FIELD

The present teachings relate to a spring steel and a spring, and in preferred embodiments, to a spring steel and a spring having superior corrosion fatigue strength.

DESCRIPTION OF RELATED ART

In recent years, there has been a growing demand for spring steel and springs having higher strengths. In high-strength springs, however, when the hardness has been increased in order to maintain the sag resistance, the impact resistance, toughness and corrosion fatigue strength of the steel have tended to decrease. Various materials have been considered from the standpoint of optimizing these various properties, such as in WO 2006/022009 and its English counterpart US 2007/0256765.

SUMMARY

However, even if the material compositions described in the above-mentioned patent document are used, it has been difficult to optimize each of the above-mentioned properties at an acceptable level and at a low cost. Therefore, an object of the disclosure of the present teachings is to provide an improved spring steel and a spring, e.g., having superior corrosion fatigue resistance.

As a result of conducting studies on various spring steel alloy compositions, the inventors discovered a range of spring steel alloy compositions that, e.g., exhibit satisfactory corrosion fatigue strength or corrosion fatigue resistance (hereinafter collectively "corrosion fatigue strength") while also maintaining high strength.

In this regard, a preferred spring steel may comprise, in terms of percent by mass:

0.35-0.55% C;

1.60-3.00% Si;

0.20-1.50% Mn;

0.10-1.50% Cr; and at least one element selected from the group consisting of: 0.40-3.00% Ni, 0.05-0.50% Mo and 0.05-0.50% V;

the balance being substantially or predominantly Fe, minor incidental elements and impurities, wherein the following formulas (1) and (2) are satisfied:

$$3.20\% \leqq C(\%)+Si(\%)+Mn(\%)+Cr(\%) \leqq 3.70\% \quad (1) \text{ and}$$

$$1.20\% \leqq Si(\%)-0.46C(\%)-1.08Mn(\%) \quad (2).$$

All percentages mentioned herein are mass percentages, unless otherwise indicated.

In a further aspect of the present teachings, the spring steel may further satisfy at least one of the following formulas (3) and (4):

$$159C(\%)-Si(\%)+8Mn(\%)+12Cr(\%) \leqq 84\% \quad (3) \text{ and}$$

$$6.0C(\%)-Si(\%)-0.3Mn(\%)+1.4Cr(\%) \leqq 1.2\% \quad (4).$$

Therefore, the spring steel may further satisfy formula (3), and not satisfy formula (4). Alternatively, the spring steel may further satisfy formula (4), and not satisfy formula (3). Alternatively, the spring steel may further satisfy both formulas (3) and (4).

In addition or in the alternative, the spring steel may also further satisfy at least one of the following formulas (5) and (6):

$$3.35\% \leqq C(\%)+Si(\%)+Mn(\%)+Cr(\%) \leqq 3.65\% \quad (5) \text{ and}$$

$$1.35\% \leqq Si(\%)-0.46C(\%)-1.08Mn(\%) \quad (6).$$

Therefore, the spring steel may further satisfy formula (5), and not satisfy formula (6). Alternatively, the spring steel may further satisfy formula (6), and not satisfy formula (5). Alternatively, the spring steel may further satisfy both formulas (5) and (6).

In addition or in the alternative, the spring steel may also further satisfy at least one of the formulas (7) and (8):

$$159C(\%)-Si(\%)+8Mn(\%)+12Cr(\%) \leqq 82\% \quad (7) \text{ and}$$

$$6.0C(\%)-Si(\%)-0.3Mn(\%)+1.4Cr(\%) \leqq 1.0\% \quad (8).$$

Therefore, the spring steel may further satisfy formula (7), and not satisfy formula (8). Alternatively, the spring steel may further satisfy formula (8), and not satisfy formula (7). Alternatively, the spring steel may further satisfy both formulas (7) and (8).

In addition or in the alternative, in the spring steel, C may be 0.45 to 0.50%, Si may be 2.00 to 2.50% and/or Mn may be 0.40 to 0.50%. Moreover, the spring steel may further include Ni, Mo and/or V. C is preferably 0.46 to 0.49%.

In addition or in the alternative, after treating the spring steel by quenching and tempering, the spring steel optionally may satisfy one, two or all of the following properties (1) to (3):

(1) a corrosion endurance of 40,000 oscillation cycles or more (and preferably 45,000 or more);

(2) a Charpy impact value of 70 J/cm$^2$ or more (and preferably 80 J/cm$^2$ or more); and/or (3) a delayed fracture strength of 800 MPa or more (and preferably 910 MPa or more).

In addition, the spring steel preferably has a Rockwell hardness of HRC 53 to 56 after quenching and tempering.

In another aspect of the present teachings, a spring is also provided that is produced from any of the above-mentioned spring steels and has an HRC value within 53 to 56.

DETAILED DESCRIPTION OF INVENTION

According to the spring steel disclosed in the present teachings, a spring can be produced that has satisfactory durability, such as satisfactory corrosion fatigue strength, as a result of having the above-mentioned composition and satisfying the above-mentioned formulas (1) and (2). The composition of the alloy components in the spring steel disclosed in the present teachings contributes to the satisfactory strength and corrosion fatigue strength, and formula (1) relates to the carbon equivalents thereof. By providing these elements, namely C, Si, Mn, Cr, Mo and V, in amounts that satisfy formula (1), a spring steel having a desired strength can be easily realized by quenching and tempering, typically having a Rockwell Hardness C strength of about HRC 53 to HRC 56. In addition, if formula (1) is satisfied, the spring steel is much less inclined to excessively harden after rolling, and the occurrence of breakage, surface defects or the like is inhibited when drawing the spring steel. In addition, by satisfying formula (2), a spring steel having satisfactory durability, such as corrosion fatigue strength, can be produced. The following provides a detailed explanation of embodiments disclosed in the present description.

Representative, non-limiting examples of the present invention will now be described in further detail. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved spring steel and springs composed of the spring steel.

Moreover, combinations of features and steps disclosed in the following detail description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

(Spring Steel)

The spring steel of the present teachings includes, in terms of percent by mass: 0.35 to 0.55% C, 1.60 to 3.00% Si, 0.20 to 1.50% Mn and 0.10 to 1.50% Cr.

(C: Carbon)

The concentration of C is preferably 0.35 to 0.55%. If the concentration of C in the spring steel is within this range, a spring steel having a satisfactory strength can be obtained by quenching and tempering. If the concentration of C is less than 0.35%, a spring steel having the satisfactory strength cannot be obtained after quenching and tempering for certain aspects or applications of the present teachings. In addition, if the concentration of C exceeds 0.55%, toughness may decrease and quenching cracks may occur during water quenching. Moreover, there is also a risk of a decrease in fatigue strength and corrosion fatigue strength. The concentration of C is preferably 0.45 to 0.50%, although the preferred concentration is dependent on the other alloy components and their concentrations. If the concentration of C is within this range, in addition to being easy to realize satisfactory strength, it also becomes easy to obtain satisfactory durability, including corrosion fatigue strength, by suitably satisfying one or two or more of the formulas (1) to (8) in accordance with the relative concentrations of the other alloy components. More preferably, the upper limit of the concentration of C is 0.49% and even more preferably 0.48%. In addition, the lower limit of the concentration of C is preferably 0.46%, and more preferably 0.47%.

(Si: Silicon)

The concentration of Si is preferably 1.60 to 3.00%. In the spring steel, a Si concentration within this range is effective for improving sag resistance, tempering properties and corrosion fatigue strength. When the concentration of Si is within this range, the corrosion fatigue strength increases with an increase in the concentration of Si. If the concentration of Si is less than 1.60%, it is difficult to obtain these effects, while if the concentration of Si exceeds 3.00%, toughness also readily decreases and decarburization is promoted during rolling and heat treatment (quenching). The lower limit of the concentration of Si in the spring steel is preferably 2.00% and more preferably 2.10% in order to optimize corrosion fatigue strength, etc. In addition, the upper limit of the concentration of Si is preferably 2.50% and more preferably 2.40%.

(Mn: Manganese)

The concentration of Mn is preferably 0.20 to 1.50%. Satisfactory corrosion fatigue strength can be obtained in the spring steel if the Mn concentration is within this range. If the concentration of Mn exceeds 1.50%, corrosion fatigue strength tends to decrease. If the concentration of Mn is less than 0.20%, strength and quenching properties tend to decrease and cracking tends to readily occur during rolling. In view of this, the upper limit of the concentration of Mn in the spring steel is more preferably 0.70%, and even more preferably 0.50% or less. The lower limit of the concentration of Mn is more preferably 0.40%.

(Cr: Chromium)

The concentration of Cr is preferably 0.10 to 1.50%. When the concentration of Cr in the spring steel is within this range, it is useful for ensuring strength and improving quenching properties. If the concentration of Cr is less than 0.10%, these effects become insufficient for certain aspects or applications of the present teachings. In addition, if the concentration of Cr exceeds 1.50%, the tempered structure becomes heterogeneous and there is greater risk of impairing the sag resistance. The upper limit of the concentration of Cr is more preferably 0.30% and the lower limit is more preferably 0.20%.

The spring steel of the present teachings preferably includes one or two or all elements selected from the group consisting of 0.40 to 3.00% Ni, 0.05 to 0.50% Mo and 0.05 to 0.50% V. Most preferably, the spring steel includes all three of these elements within the above-mentioned concentrations. In this case, in addition to obtaining satisfactory toughness, satisfactory corrosion fatigue strength is also obtained for certain aspects or applications of the present teachings.

(Ni: Nickel)

The concentration of Ni is preferably 0.40 to 3.00%. When the concentration of Ni in the spring steel is within this range, it has the effect of improving corrosion resistance. If the concentration of Ni is less than 0.40%, that effect becomes insufficient for certain aspects or applications of the present teachings. If the concentration of Ni exceeds 3.00%, further improvements in the corrosion resistance are not observed, because this effect tends to peak or reach a maximum (become saturated) at about 3.00%. More preferably, the upper limit of the concentration of Ni is 1.00% or less, and even more preferably 0.60% or less. The spring steel preferably includes at least Ni from the group of Ni, Mo and V.

(Mo: Molybdenum)

The concentration of Mo is preferably 0.05 to 0.50%. When the concentration of Mo in the spring steel within this range, corrosion fatigue strength can be improved. If the concentration of Mo is less than 0.05%, this effect becomes insufficient for certain aspects or applications of the present teachings, and if the concentration of Mo exceeds 0.50%, no further improvements in the corrosion resistance are observed, because this effect tends to peak or reach a maximum (become saturated) at about 0.50%. The concentration of Mo is preferably 0.20% or less, and more preferably 0.10% or less.

(V: Vanadium)

The concentration of V is preferably 0.05 to 0.50%. When the concentration of V in the spring steel is within this range, it is effective for reducing the size of the crystal grains and for improving the precipitation hardening. If the concentration of V is less than 0.05%, this effect becomes insufficient for this purpose, while if the concentration of V exceeds 0.50%, there is a risk of carbides forming corrosion pits in the steel surface and these pits becoming the starting points of cracking fractures. In addition, toughness decreases. More preferably, the concentration of V is 0.30% or less, and even more preferably 0.20% or less. The concentration of V is still more preferably 0.10% or less.

In addition, the spring steel can include P (phosphorous). Since P tends to cause the crystal grain boundaries to become brittle, the concentration of P is preferably 0.010% or less, and more preferably 0.005% or less.

In addition, the spring steel can include S (sulfur). Since S also tends to cause the crystal grain boundaries to become brittle in the same manner as P, the concentration of S is preferably 0.010% or less, and more preferably 0.005% or less.

The spring steel can include Cu (copper). The concentration of copper in the spring steel is preferably 0.20% or less, and more preferably 0.05% or less.

The spring steel can include Ti (titanium; preferably at a concentration of 0.005 to 0.030%) in addition to the above-described alloy components. In addition, the spring steel can include B (boron; preferably at a concentration of 0.0015 to 0.0025%). In addition to including these alloy components, the balance of the spring steel is one of at least substantially, predominantly or completely Fe (iron) and, e.g., no more than minor amounts of incidental elements and/or unavoidable impurities.

In addition to having the above-described alloy composition, the spring steel preferably satisfies one or more of the following formulas (1) to (8).

$$3.20\% \leqq C(\%)+Si(\%)+Mn(\%)+Cr(\%) \leqq 3.70\% \quad \text{Formula (1)}$$

The lower limit value of formula (1) indicates the lower limit value for obtaining the desired strength after quenching and tempering the steel, as sufficient strength cannot be obtained for certain aspects or applications of the present teachings at values less than the lower limit value. In addition, the upper limit value of formula (1) indicates the upper limit value for obtaining the desired strength, and if the value exceeds the upper limit value, the spring steel becomes excessively hardened after rolling. Further, there is a risk of the occurrence of breakage, surface defects or the like when drawing the spring steel. The range of formula (1) is preferable for obtaining a Rockwell hardness within the range of HRC 53 to HRC 56. The lower limit value of the formula (1) is preferably 3.35%, and the upper limit value of the formula (1) is preferably 3.65%. Thus, the spring steel preferably further satisfies the following formula (5):

$$3.35\% \leqq C(\%)+Si(\%)+Mn(\%)+Cr(\%) \leqq 3.65\% \quad \text{Formula (5).}$$

Furthermore, the lower limit value is particularly preferably 3.60% and the upper limit value is particularly preferably 3.63%. Furthermore, the strength intended by formula (1) is preferably the Rockwell hardness C (HRC).

The spring steel preferably satisfies both the following formula (2) and formula (1). Satisfying these two formulas makes it possible to easily obtain spring steel having high strength and superior corrosion fatigue strength.

$$1.20\% \leqq Si(\%)-0.46C(\%)-1.08Mn(\%) \quad \text{Formula (2)}$$

Formula (2) is a formula by which corrosion fatigue strength is obtained by selecting the concentrations of C, Si and Mn as parameters for the alloy components of the spring steel, and is a formula for obtaining spring steel having the superior corrosion fatigue strength. When the value is less than the lower limit value of formula (2), a corrosion fatigue strength sufficient for certain aspects or applications of the present teachings cannot be obtained. The lower limit value is preferably 1.30%, and more preferably 1.35%. Thus, the present spring steel preferably further satisfies the following formula (6):

$$1.35\% \leqq Si(\%)-0.46C(\%)-1.08Mn(\%) \quad \text{Formula (6).}$$

Furthermore, the lower limit value is particularly preferably 1.40%, even more preferably 1.45%, and still more preferably 1.50%. In addition, although the upper limits are not particularly defined in formulas (2) and (6), if the goal is to achieve high strength and inhibit decarburization, the upper limit is preferably 1.90%, more preferably 1.75%, and even more preferably 1.70%. Furthermore, the corrosion fatigue strength intended by formula (2) is preferably obtained according to the testing method described in the examples below.

Although the spring steel may only satisfy formula (2), it preferably satisfies both formulas (1) and (2), and particularly preferably also satisfies both formulas (5) and (6). In this case, a spring steel can be obtained that has a further improved or superior corrosion fatigue strength.

$$159C(\%)-Si(\%)+8Mn(\%)+12Cr(\%) \leqq 84\% \quad \text{Formula (3)}$$

Formula (3) is a formula by which the Charpy impact value is obtained by selecting the concentrations C, Si, Mn and Cr as parameters for the alloy components of the spring steel, and is a formula for obtaining a spring steel having a satisfactory Charpy impact value. When the value is less than the lower limit value of the formula (3), an adequate Charpy impact value (tenacity) cannot be obtained for certain aspects and applications of the present teachings. The upper limit value is preferably 82%. Thus, the present spring steel preferably satisfies the following formula (7):

$$159C(\%)-Si(\%)+8Mn(\%)+12Cr(\%) \leqq 82\% \quad \text{Formula (7).}$$

Furthermore, the upper limit value is more preferably 81%. Although the lower limit of formulas (3) and (7) is not particularly defined, it is preferably 60%, and more preferably 70%. Furthermore, the Charpy impact value intended by formulas (3) and (7) is preferably a value obtained according to the testing method described in the examples below.

$$6.0C(\%)-Si(\%)-0.3Mn(\%)+1.4Cr(\%) \leqq 1.2\% \quad \text{Formula (4)}$$

Formula (4) is a formula by which the delayed fracture strength is obtained by selecting the concentrations of C, Si, Mn and Cr as parameters for the alloy components of the spring steel, and is a formula for obtaining a spring steel having satisfactory delayed fracture strength. A delayed fracture strength sufficient for certain aspects or applications of the present teachings cannot be obtained if the upper limit value in formula (4) is exceeded. The upper limit value of the formula (4) is preferably 1.0%. Thus, the spring steel preferably further satisfies the following formula (8):

$$6.0C(\%)-Si(\%)-0.3Mn(\%)+1.4Cr(\%) \leqq 1.0\% \quad \text{Formula (8).}$$

Furthermore, the upper limit value is more preferably 0.95%. Although the lower limit of formulas (4) and (8) is not particularly defined, it is preferably 0.65%, more preferably 0.68%, and even more preferably 0.70% for achieving sufficient strength and inhibiting decarburization. Furthermore, the delayed fracture strength intended by formulas (4) and (8) is preferably a strength value obtained according to the testing method described in the examples below.

The hardness of the spring steel is preferably adjusted to an HRC of 53 to 56 after a quenching and tempering treatment. If the Rockwell hardness is within this range, a lightweight and high-strength spring can be obtained. In addition, the corrosion fatigue strength, the Charpy impact value and/or the delayed fracture strength of the spring steel preferably satisfy the following properties after the quenching and tempering treatment. Namely, with respect to the corrosion fatigue strength, the number of corrosion endurance oscillation cycles is preferably 40,000 oscillation cycles or more, and more preferably 45,000 oscillation cycles or more. In addition, the Charpy impact value is preferably 70 J/cm$^2$ or more, more preferably 80 J/cm$^2$ or more, and even more preferably 85 J/cm$^2$ or more. Moreover, the delayed fracture strength is preferably 800 MPa or more, more preferably 900 MPa or more, even more preferably 910 MPa or more, and still more preferably 950 MPa or more.

An explanation will now be provided of preferred methods for producing a spring using the above-described spring steel. The spring steel disclosed herein can be used to produce various types of springs by performing one or more of a known hot forming step, a cold forming step, a warm forming step, etc. For example, a representative coil spring can be produced in the following manner. Specifically, after shaping the spring steel disclosed in the present teachings into a round steel bar, a wire rod, a wire, a plate material, etc., the material can be formed into the shape, e.g., of the coil, then warm shot peening can be carried out on the coil, and then hot setting (also known as a hot set process and heat setting) can be carried out on the warm shot-peened coil in order to produce the spring. A coil spring for an automobile suspension having superior sag resistance and durability can be obtained by utilizing such a production method. An example of a more specific embodiment is a coil spring for an automobile suspension that is produced using the spring steel disclosed in the present description and by carrying out steps that include one or more of coil formation, heat treatment, hot setting, warm shot peening, cold shot peening and cold setting. The coil formation step may be carried out in a hot mode (at a temperature equal to or higher than the recrystallization temperature of the wire material), in a warm mode (at a temperature lower than the recrystallization temperature of the wire material) or in a cold mode (e.g., at room temperature). In addition, various conventionally known methods can be used to form the material into the shape of a coil. For example, the coil may be formed using a coiling machine or by a method in which the material is wound around a core bar.

In the heat treatment step, heat treatment is carried out on a coil that has been formed into the shape of a coil after the above-mentioned coil formation step. The heat treatment carried out in this step differs depending on whether the above-mentioned coil formation step was carried out in the hot mode, the warm mode or the cold mode. For example, if the hot mode coil formation step was utilized, quenching and tempering are carried out on the coil. Strength and toughness are imparted to the coil by quenching and tempering. On the other hand, if the cold mode coil formation step was utilized, low-temperature annealing is carried out on the coil, which removes harmful residual stress (tensile residual stress) from the interior and surface of the coil. The quenching and tempering, as well as the low-temperature annealing, can be carried out on the coil according to any conventionally known method.

In the hot setting step, the setting is carried out with the coil at a warm temperature. The hot setting improves durability by applying a directional compressive residual stress to the coil; the sag resistance of the coil is also improved by generating a comparatively large plastic deformation in the coil. In the present example, the temperature at which the hot setting is carried out can be suitably set within a temperature range that is equal to or lower than the recrystallization temperature of the wire material and is higher than room temperature. For example, hot setting of the coil can be carried out at a temperature within the range of 150 to 400° C. As a result of carrying out the setting within such a temperature range, the amount of plastic deformation imparted to the coil can be increased and sag resistance can be improved. In addition, the amount of sag $\delta h$ of the setting can be suitably determined in accordance with the total length L (total length Ls during the setting) of the automobile suspension coil spring. Furthermore, various conventionally known methods can be used for the setting process.

In the warm shot peening step, a coil that has undergone the above-described heat treatment is then subjected to warm shot peening, which improves the durability and the corrosion fatigue resistance by imparting a large compressive residual stress to the coil surface. In the present example, the temperature at which the shot peening is carried out can be suitably set within a temperature range that is equal to or lower than the recrystallization temperature of the wire material and is higher than room temperature. For example, warm shot peening treatment of the coil can be carried out at a coil temperature of 150 to 400° C. Furthermore, various conventionally known methods can be used in a steel ball shot peening method.

In the cold shot peening step, shot peening is carried out with the coil at room temperature, preferably using steel balls. The durability of the coil can be further improved by additionally carrying out cold shot peening after warm shot peening. In this case, the diameter of the steel balls used in the cold shot peening step is preferably smaller than the diameter of the steel balls used in the warm shot peening step. For example, if the diameter of steel balls used in the warm shot peening step is 1.2 mm, then the diameter of steel balls used in the cold shot peening is preferably 0.8 mm. The surface roughness of the coil can improved by performing the cold shot peening step after having imparted a large compressive residual stress in the previously-performed warm shot peening step, thereby further improving the durability and the corrosion fatigue resistance of the coil. Furthermore, various conventionally known methods can be used in the steel ball shot peening step.

In the cold setting step, the setting is carried out with the coil at room temperature. The sag resistance of the coil is further improved by carrying out the cold setting step after performing the above-mentioned hot setting step. The amount of sag $\delta c$ of the cold setting can be suitably determined in accordance with the total length L (total length Ls during the setting) of the automobile suspension coil spring. Furthermore, the amount of sag $\delta c$ of the cold setting is preferably less than the amount of sag $\delta h$ of the hot setting.

Alternatively, the production can also be carried out by only performing the warm shot peening step and the hot setting step, while omitting both of the cold shot peening step and cold setting step described above. In addition, other steps may be included in addition to each of the above-mentioned steps. For example, a water cooling step may be carried out after the hot setting step. In addition, the warm shot peening step may be performed prior to the hot setting to achieve springs having further improved durability.

As has been explained above, according to the present teachings, a spring steel and a spring having the high strength and the superior durability in terms of the corrosion fatigue strength, etc. can be obtained. Such a spring is preferably used in components of vehicle suspension systems or the like, such as coil springs, leaf springs, torsion bar springs and/or stabilizer bars.

EXAMPLES

The following provides an explanation of examples that embody the present teachings. Furthermore, the following examples are merely specific examples for explaining the present teachings, and do not limit the present teachings or the claims.

Steels of exemplary samples and comparative samples having the chemical compositions shown in Table 1 below were each produced using the following two types of production methods. Specifically, the steels used in samples 1 to 5 and comparative samples 1 to 7, which were utilized for the corrosion fatigue test, were produced according to method (2) below, while the steel used in comparative sample 8 was produced according to method (1) below. Moreover, the steels used in the test for determining the Charpy impact value and in the delayed fracture test were produced according to method (2) below.

(1): Steel ingots, which were obtained by melting steel in a blast furnace or an electric arc furnace on a scale equivalent to a mass production, were split into slabs and rolled, followed by rolling into wire rods.

(2) After melting two tons of steel in a vacuum furnace, the melt was split into slabs and rolled, followed by rolling into wire rods.

TABLE 1

(all values are mass %)

| | C | Si | Mn | Cr | P | S | Ni | Cu | Mo | V | Ti | B |
|---|---|---|---|---|---|---|---|---|---|---|---|---|
| Sample 1 | 0.46 | 2.19 | 0.70 | 0.19 | 0.004 | 0.005 | 0.30 | 0.18 | 0.18 | 0 | 0.023 | 0.0020 |
| Sample 2 | 0.46 | 2.17 | 0.69 | 0.19 | 0.005 | 0.007 | 0.27 | 0.01 | 0.08 | 0.09 | 0.024 | 0.0021 |
| Sample 3 | 0.47 | 2.18 | 0.44 | 0.29 | 0.004 | 0.004 | 0.53 | 0.01 | 0.09 | 0.10 | 0.023 | 0.0021 |
| Sample 4 | 0.48 | 2.40 | 0.45 | 0.28 | 0.004 | 0.004 | 0.53 | 0.01 | 0.09 | 0.10 | 0.024 | 0.0020 |
| Sample 5 | 0.47 | 2.38 | 0.45 | 0.29 | 0.004 | 0.004 | 0.55 | 0.01 | 0.18 | 0.10 | 0.024 | 0.0020 |
| Comp. Sample 1 | 0.46 | 2.18 | 0.99 | 0.17 | 0.005 | 0.004 | 0.31 | 0.02 | 0.18 | 0 | 0.023 | 0.0020 |
| Comp. Sample 2 | 0.45 | 2.19 | 0.69 | 0.47 | 0.005 | 0.005 | 0.26 | 0.02 | 0.18 | 0 | 0.022 | 0.0020 |
| Comp. Sample 3 | 0.48 | 1.80 | 0.70 | 0.19 | 0.006 | 0.004 | 0.27 | 0.01 | 0.10 | 0.08 | 0.018 | 0.0017 |
| Comp. Sample 4 | 0.49 | 1.80 | 0.69 | 0.18 | 0.005 | 0.004 | 0.26 | 0.18 | 0.09 | 0.09 | 0.021 | 0.0020 |
| Comp. Sample 5 | 0.48 | 1.80 | 0.95 | 0.19 | 0.006 | 0.004 | 0.26 | 0.01 | 0.08 | 0.08 | 0.022 | 0.0021 |
| Comp. Sample 6 | 0.49 | 1.98 | 0.72 | 0.17 | 0.007 | 0.006 | 0.51 | 0.01 | 0 | 0.19 | 0.021 | 0.0022 |
| Comp. Sample 7 | 0.48 | 1.94 | 0.70 | 0.16 | 0.007 | 0.005 | 0.53 | 0.01 | 0.20 | 0.19 | 0.020 | 0.0023 |
| Comp. Sample 8 | 0.47 | 2.18 | 0.77 | 0.36 | 0.010 | 0.002 | 0.97 | 0.26 | 0 | 0.20 | 0 | 0.0020 |

Testing was carried out on various properties of these steels using the methods described below.

1. Corrosion Fatigue Test (1) Test Piece Preparation

The test pieces were obtained by performing the following steps on the wire rods formed from each steel in sequence: surface polishing, heating, hot-forming the coil, oil quenching and tempering, thereby forming coil springs. Furthermore, the heating condition was high-frequency induction heating at 990° C., thereby adjusting the spring hardness (post-tempering hardness) to HRC 55. An overview of the resulting coil springs is shown in Table 2 below.

TABLE 2

| Spring shape | Wire diameter (mm) | Coil average diameter (mm) | Free length (mm) | Effective no. of turns (turns) | Spring constant (N/mm) |
|---|---|---|---|---|---|
| Cylindrical | ϕ12.4 | ϕ110.9 | 323 | 4.05 | 39.1 |

(2) Test Methods

Pits were artificially formed on the resulting springs, and a fatigue test (Japanese Automobile Standards Organization (JASO) C 604) was conducted in a corrosive environment. The pits were formed by disposing a mask having small holes on the outer surface of each spring at a location (3.1 turns from the end of the coil) where the principal stress amplitude is the greatest, and then forming hemispherical recesses (artificial pits) having a diameter of 600 μm and a depth of 300 μm by electrolytic etching. The stress concentration factor of the perpendicular stress (principal stress) in the torsion load attributable to these pits was 2.2 according to a finite element analysis. An aqueous ammonium chloride solution was used as the electrolyte. The corrosive environment consisted of corroding only the portion of the spring having the artificial pits using a misting apparatus that sprayed a 5% aqueous NaCl solution as the corrosive liquid for 16 hours, and then covering the artificial pit portion circumference with absorbent cotton impregnated with 5% aqueous NaCl solution and preventing it from drying out using an ethylene wrap. The fatigue test was conducted while the spring was in this wrapped state, and the number of oscillating cycles until the test piece broke was determined. A spring oscillating rate of 2 Hz was used in the fatigue test, and excitations were applied by parallel compression using a flat base. The test heights were determined based on a principal stress condition of 507±196 MPa that was determined as if no artificial pits were actually formed in the artificial pit portion (a height of 220 mm at the maximum load (4031 N) and a height of 270 mm at the minimum load (2079 N)). The results are collectively shown in Table 3. Table 3 also shows the numerical values of formulas (1) to (4) based on the chemical composition along with whether each formula is satisfied.

TABLE 3

| | Formula 1 3.2 to 3.7 | | Formula 2 1.2 or more | | Formula 3 84 or less | | Formula 4 1.2 or less | | Corrosion endurance cycles (cycles) | Charpy impact value J/cm$^2$ | Delayed fracture strength MPa |
|---|---|---|---|---|---|---|---|---|---|---|---|
| Sample 1 | 3.54 | Y | 1.222 | Y | 78.83 | Y | 0.63 | Y | 42518 | 82 | |
| Sample 2 | 3.51 | Y | 1.213 | Y | 78.77 | Y | 0.65 | Y | 41307 | 74 | |
| Sample 3 | 3.38 | Y | 1.489 | Y | 79.55 | Y | 0.91 | Y | 49493 | 86 | 1020 |
| Sample 4 | 3.61 | Y | 1.693 | Y | 80.88 | Y | 0.74 | Y | 59021 | 86 | 980 |
| Sample 5 | 3.59 | Y | 1.678 | Y | 79.43 | Y | 0.71 | Y | 50595 | | |
| Comp. Sample 1 | 3.80 | N | 0.899 | N | 80.92 | Y | 0.52 | Y | 28682 | 81 | |
| Comp. Sample 2 | 3.80 | N | 1.238 | Y | 80.52 | Y | 0.96 | Y | 32491 | 78 | |
| Comp. Sample 3 | 3.17 | N | 0.823 | N | 82.40 | Y | 1.14 | Y | 26538 | | |
| Comp. Sample 4 | 3.16 | N | 0.829 | N | 83.79 | Y | 1.19 | Y | 30777 | | |
| Comp. Sample 5 | 3.42 | Y | 0.553 | N | 84.40 | N | 1.06 | Y | 27821 | 75 | 900 |
| Comp. Sample 6 | 3.36 | Y | 0.977 | N | 83.73 | Y | 0.98 | Y | 35813 | | |
| Comp. Sample 7 | 3.28 | Y | 0.963 | N | 81.90 | Y | 0.95 | Y | 25920 | | |
| Comp. Sample 8 | 3.78 | N | 1.132 | N | 83.03 | Y | 0.91 | Y | 31636 | | 766 |

In Table 3, a "Y" is indicated for those samples that satisfy the range of formulas (1) to (4), while an "N" is indicated for those samples that do not satisfy the range of formulas (1) to (4). As shown in Table 3, samples 1 to 5 satisfy all of formulas (1) to (4).

2. Charpy Impact Value (1) Test Piece Preparation

Half-size test pieces (in which a U-shaped notch, which measured 2 mm (width)×2 mm (depth)×R1 (bottom of U), was formed in the center portion of a rectangular column having a cross-sectional area of 5×10 mm and a length of 55 mm) were used in each of the samples and the comparative samples.

(2) Heating Conditions

The heating conditions consisted of heating at 900° C. for 30 minutes for samples 1 and 2 and comparative samples 1 and 2, high-frequency induction heating at 960° C. for comparative sample 5 and high-frequency induction heating at 990° C. for samples 3 and 4.

(3) Test Piece Hardness

The hardness after tempering was adjusted to HRC 55.

(4) Test Method

Testing was conducted based on JIS ("Japanese Industrial Standard") Z2242 using room temperature as the testing temperature. The results are shown in Table 3.

3. Delayed Fracture Test (Samples 3 and 4 and Comparative Samples 5 and 8)

Tensile test pieces (with a circular notch having a depth of 1 mm) were used as the test pieces. In addition, a constant-force load, hydrogen-charging method was used as the test method. More specifically, in this test, the delayed fracture is caused by internal hydrogen, wherein a load is applied to the test piece at a constant force while the test piece is immersed in an $H_2SO_4$ solution at pH 3 and a current density of 1.0 mA/cm$^2$ is applied to the test piece in order to charge the hydrogen into the test piece. The amount of time until fracture was measured. The maximum load stress that did not cause fracture after 200 hours or more was estimated as the delayed fracture strength.

The heating conditions for the above-mentioned test pieces were as follows. Specifically, the heating conditions consisted of high-frequency induction heating at 990° C. for samples 3 and 4, high-frequency induction heating at 960° C. for comparative sample 5 and heating at 900° C. for 30 minutes for comparative sample 8. These results are also shown in Table 3.

As shown in Table 3, samples 1 to 5, which are examples of the present teachings, were all determined to have a satisfactory number of corrosion endurance oscillation cycles. All of these samples also satisfied formulas (1) to (4). Samples 3 to 5, in which the lower limit of the formula (2) was 1.45% or more, exhibited particularly satisfactory results. In addition, the results were satisfactory with respect to the Charpy impact values as well for samples 1 to 4 that satisfied formulas (1) to (4). The results were also satisfactory for sample 5 as a result of satisfying formulas (1) to (4) in the same manner as samples 1 to 4. Furthermore, the results for the Charpy impact value were particularly satisfactory for samples 3 and 4, in which the upper limit of the formula (3) was 81% or less. Satisfactory results were demonstrated with respect to the delayed fracture strength by samples 3 and 4, which satisfied formulas (1) to (4), and similarly satisfactory results are also obtained for samples 1, 2 and 5.

Additional teachings relevant to, and advantageously combinable with the present teachings, are found in, e.g., commonly-owned U.S. Pat. Nos. 4,448,617, 4,544,406, 5,897,717, 6,017,641, 6,027,577, 6,193,816, 6,375,174, 6,543,757, 6,550,301, 6,616,131, 6,648,996, 6,712,346, 6,779,564, 6,836,964, 7,407,555, 7,699,943, 7,776,440, and U.S. Patent Publication Numbers 2009/0079246, 2011/0074076, 2011/0074078 and 2011/0074079, the contents of all of which are hereby incorporated by reference as if fully set forth herein.

The invention claimed is:

1. A steel alloy comprising, in terms of percent by mass:

0.47-0.49% C, 2.10-2.40% Si, 0.40-0.50% Mn, 0.20-0.30% Cr,
0.40-0.6% Ni,
0.05-0.20% Mo and
0.05-0.20% V;
the balance being at least substantially Fe, incidental elements and impurities, and
wherein the following formula (5) is satisfied:

$$3.35\% \leqq C(\%)+Si(\%)+Mn(\%)+Cr(\%) \leqq 3.65\% \quad (5).$$

2. The steel alloy according to claim 1, wherein the following formula (3) is satisfied:

$$159C(\%)-Si(\%)+8Mn(\%)+12Cr(\%) \leqq 84\% \quad (3).$$

3. The steel alloy according to claim 2, wherein formula (3) is less than or equal to 82%.

4. The steel alloy according to claim 3, wherein the following formula (4) is satisfied:

$$6.0C(\%)-Si(\%)-0.3Mn(\%)+1.4Cr(\%) \leqq 1.2\% \quad (4).$$

5. The steel alloy according to claim 4, wherein formula (4) is less than or equal to 1.0%.

6. The steel alloy according to claim 5, wherein the following formula (6) is satisfied:

$$1.35\% \leqq Si(\%)-0.46C(\%)-1.08Mn(\%) \quad (6).$$

7. The steel alloy according to claim 6, wherein formula (6) is greater than or equal to 1.45%.

8. The steel alloy according to claim 7, wherein, after quenching and tempering, the steel alloy has a property that its number of corrosion endurance oscillation cycles is at least 45,000.

9. The steel alloy according to claim 8, wherein, after quenching and tempering, the steel alloy has a property that its Charpy impact value is at least 80 J/cm$^2$.

10. The steel alloy according to claim 9, wherein, after quenching and tempering, the steel alloy has a property that its delayed fracture strength is at least 910 MPa.

11. The steel alloy according to claim 10, wherein the steel alloy has a Rockwell hardness of HRC 53 to 56.

12. The steel alloy according to claim 11, wherein the steel alloy further has:

0.010% or less P,
0.010% or less S,
0.010% or less Cu,
0.005-0.030% Ti, and
0.0015-0.0025% B.

13. A spring comprising the steel alloy according to claim 12.

14. A spring according to claim 13, wherein the spring is a coil spring.

15. A spring comprising the steel alloy according to claim 1.

16. A spring according to claim 15, wherein the spring is a coil spring.

17. The steel alloy according to claim 1, wherein the following formula is satisfied:

$$1.45\% \leqq Si(\%)-0.46C(\%)-1.08Mn(\%).$$

18. A steel alloy, comprising, in terms of percent by mass:
0.45% to 0.50% C;
2.00 to 2.50% Si;
0.40 to 0.50% Mn;
0.10 to 1.50% Cr; and
at least one element selected from the group consisting of 0.40-3.00% Ni, 0.05-0.50% Mo and 0.05-0.50% V;
the balance being substantially Fe, incidental elements and impurities and
wherein the following formulas (5) and (6) are satisfied:

$$3.35\% \leqq C(\%)+Si(\%)+Mn(\%)+Cr(\%) \leqq 3.65\% \quad (5) \text{ and}$$

$$1.35\% \leqq Si(\%)-0.46C(\%)-1.08Mn(\%) \quad (6).$$

19. The steel alloy according to claim 18, wherein both of the following formulas (7) and (8) are satisfied:

$$159C(\%)-Si(\%)+8Mn(\%)+12Cr(\%) \leqq 82\% \quad (7) \text{ and}$$

$$6.0C(\%)-Si(\%)-0.3Mn(\%)+1.4Cr(\%) \leqq 1.0\% \quad (8),$$

wherein the steel alloy includes each of Ni, Mo and V.

20. A spring comprising the steel alloy according to claim 19.

* * * * *